United States Patent [19]

Sardoff et al.

[11] Patent Number: 4,989,551

[45] Date of Patent: Feb. 5, 1991

[54] WATER DIFFUSION PLATE FOR INJECTING WATER INTO STEAM

[75] Inventors: Hugh M. Sardoff; Hung Q. Bui, both of Bakersfield, Calif.

[73] Assignee: Texaco Inc., White Plains, N.Y.

[21] Appl. No.: 469,988

[22] Filed: Jan. 25, 1990

[51] Int. Cl.[5] ..... F22B 37/42

[52] U.S. Cl. ..... 122/504; 122/406.5; 122/487

[58] Field of Search ..... 261/78.1, DIG. 13; 122/487, 504, 406 R, 406 ST

[56] References Cited

U.S. PATENT DOCUMENTS 1,531,258 3/1925 Kieser ..... 122/487
4,130,611 12/1978 Brand ..... 122/487 X

FOREIGN PATENT DOCUMENTS 1177169 8/1961 Fed. Rep. of Germany ..... 122/487
604003 6/1948 United Kingdom ..... 261/DIG. 13

*Primary Examiner*—Edward G. Favors
*Attorney, Agent, or Firm*—Jack H. Park; Kenneth R. Priem; Russell J. Egan

[57] ABSTRACT

In a steam generation system in which cold water is introduced into steam as an incident of equipment start-up, condensation shock is substantially reduced by having a diffusion plate in a generator discharge line leading to the steam conduit. The diffusion plate breaks up the flow of water into a plurality of steams thereby substantially increasing the surface area of the water to provide enhanced heat transfer and reduced condensation shock.

5 Claims, 2 Drawing Sheets

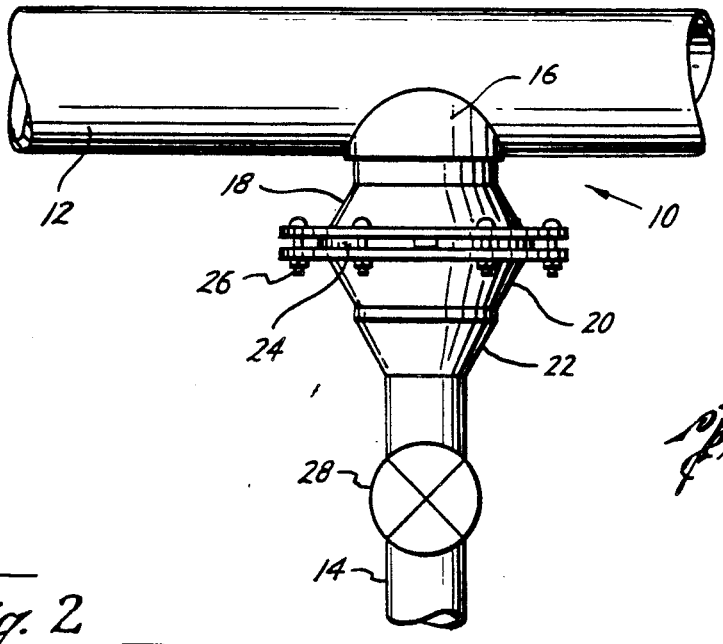
Fig. 1
Fig. 2
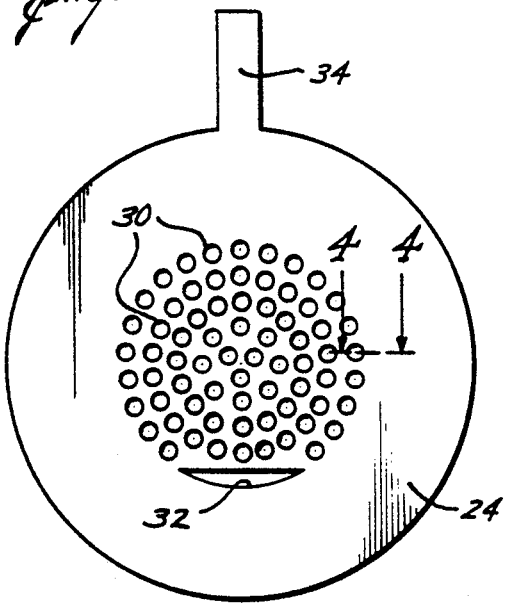
Fig. 3
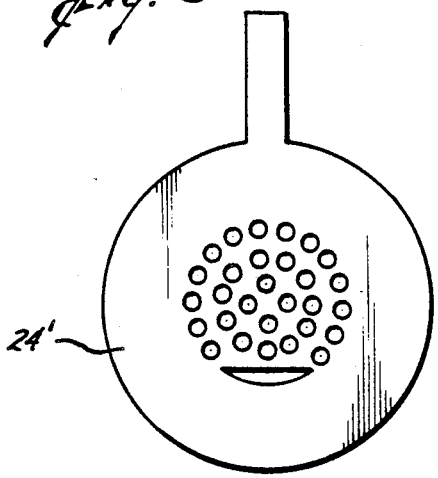
Fig. 4
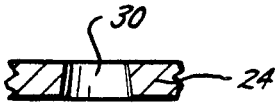

WATER DIFFUSION PLATE FOR INJECTING WATER INTO STEAM

BACKGROUND OF THE INVENTION

1. The Field of the Invention

The present invention pertains to a water diffusion plate used to induce layered fluid flow for the purpose of decreasing the effects of water slugging upon injections of large quantities of cold water into active steam lines during steam generator equipment cold start-up.

2. The Prior Art

A problem associated with the start-up of steam generating equipment has to do with cold water condensate left in the system from previous operations. All parts of the steam generating system do not simultaneously reach operating temperatures so there is the possibility that slugs of this cold water could be driven into hot steam headers. This results in a violent reaction between the steam and water.

This reaction has been known to cause structural damage in some steam header systems ranging from bending or shearing 1" thick steel bolts to cracking of concrete foundations at critical guide supports. This damage is a safety concern since, when the system is started, there generally are personnel in the immediate vicinity of the headers and they could be injured as a consequence of the damage. Repairs of the facilities to restore them to a safe operating level can be as high as $40,000 per header.

An example of the use of a steam generator where this would be a problem is the field of secondary petroleum recovery. Steam is pumped into a formation to heat the in situ oil to both change the viscosity and density of the oil and drive it away from steam injection wells toward production wells. Injection of steam can also serve to increase the pressure within a formation to drive the oil. Upon start-up of the steam operation, a separate injection system could be used to inject cold water down a start-up well with the water flow being diverted into the steam header after the water attains a similar temperature and pressure with the steam flow in those lines. But this is a costly process in terms of hardware required plus either an operator or automation to monitor and switch the flow.

It is known that, when the temperature differential between water and steam is too diverse, intermixing multiphase flow can result in a reaction having violent effects on the associated piping system. This reaction is largely due to condensation shock and is particularly apt to occur when large slugs of water, originating from a cold portion of the system, are driven into a steam header, which has reached operating temperatures. Thus there is a potentially dangerous situation existing for a period of time after steam generator start-up.

SUMMARY OF THE PRESENT INVENTION

It is an object of the present invention to provide improved mixing of steam and water in such manner as to substantially reduce condensation shock. A diffuser plate is installed in a generator discharge line to break up any water flow therethrough to increase the surface area of the water exposed to steam resulting in more rapid heating of the water plate is provided with a patterned array of apertures to break up the water flow into a plurality of streams while creating the least amount of back pressure in the water line.

BRIEF DESCRIPTION OF THE DRAWINGS

The present invention will now be described by way of example with reference to the accompanying drawings in which:

FIG. 1 is a plan view of an intersection between a steam conduit and a generator discharge pipe incorporating the present invention;

FIG. 2 is a front elevation of a first embodiment of the subject diffuser plate;

FIG. 3 is a front elevation of a second embodiment of the subject diffuser plate;

FIG. 4 is a detailed section through a hole of the subject diffusion plate;

DETAILED DESCRIPTION OF THE PREFERRED EMBODIMENT

Figure 5:
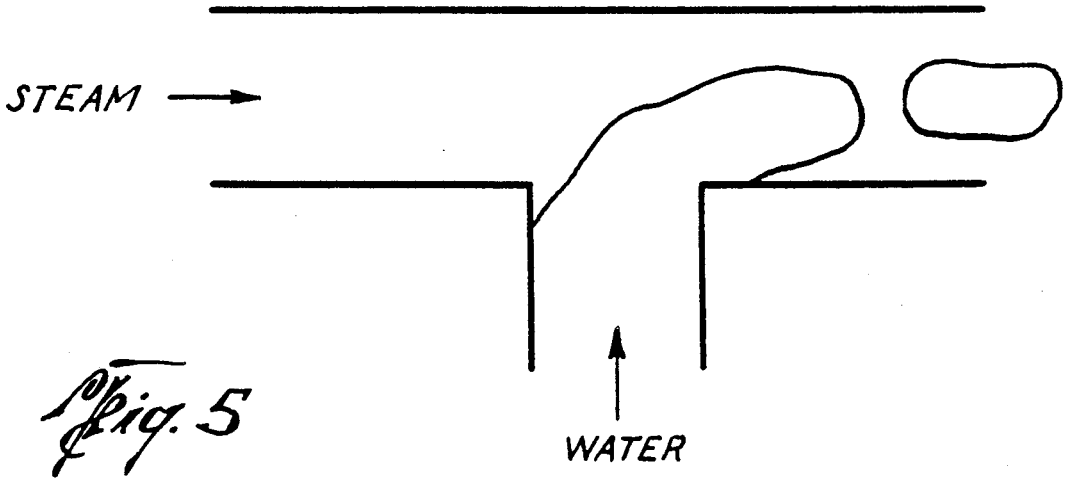
Fig. 5 PRIOR ART
FIG. 5 is a schematic representation of the operation of the prior art.

The intersection 10 between a steam conduit 12 and generator discharge pipe 14 is shown in FIG. 1. This intersection 10 is formed by a saddle 16 secured to conduit 12 by known means, such as welding. First flanged member 18 is fixed to the saddle 16 and second flanged member 20 is fixed to the larger end of a concentric reducer 22. The subject diffuser plate 24 is mounted between the flanged members 18, 20 and secured in place by bolts 26. The smaller end of the reducer 22 is fixed to the discharge pipe 14, which has a gate valve 28 mounted therein.

The details of the diffuser plates can be seen in FIGS. 2 to 4. The plates 24 and 24' are typical for 6" and 4" generator discharge pipes, respectively. Each plate is preferably formed from ¼" thick stainless steel and includes an array of apertures 30, a drain slot 32 and an indicator tab 34 extending radially from the plate opposite the drain slot 32. A detailed section through an aperture 30 is shown in FIG. 4. Each aperture tapers from a first larger diameter on the upstream side of the plate to a smaller diameter on the downstream side of the plate. Typical dimensions for apertures for 4" or 6" generator discharge pipes would be ½" tapering to 7/16". Typically there would be approximately 70 apertures for a 6" pipe and 30 apertures for a 4"pipe. The number and specific location or pattern of the apertures is not important to the invention. What is important is there should be a sufficient number of apertures to break up water flow but the total area of the apertures should not be significantly less than the area of the generator discharge pipe attached thereto. It is not the purpose of the diffusion plate to create an obstruction causing back pressure in the generator discharge pipe. Rather it is the purpose of the diffusion plate to break up the water into a plurality of streams and/or slugs so that there will be a greater surface area of the water. This greater surface area of water allows the steam to more rapidly heat the water to the vapor phase thereby reducing the mass of the water slugs entrained with the steam. The steam can then be routed around bends and through expansion joints with greater safety since the steam will have fewer entrained slugs of water which, at high velocity, have sufficient mass to structurally damage the conduit system.

Figure 6:
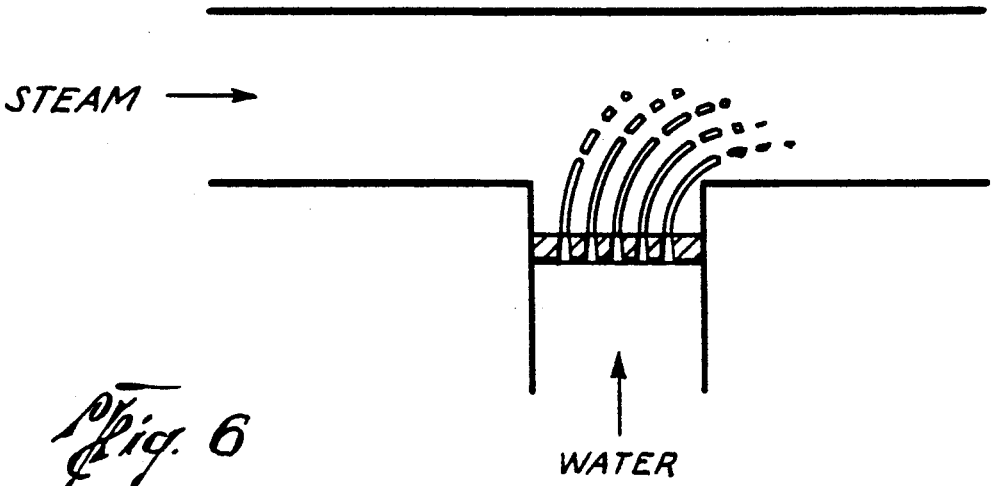
FIG. 6 is a schematic representation of the operation of the present invention.

The operation of prior art and the present invention are schematically illustrated in FIGS. 5 and 6. Previously, upon generator start-up a large slug of water (FIG. 5) having substantial mass and relatively small surface area could be injected into the steam conduit and entrained with the steam flow. It would take a long time for the water in this slug to be heated to the vapor phase/or to be reduced in volume and mass to where it would no longer be dangerous. The diffuser plate of the present invention (FIG. 6) breaks the water flow into a plurality of streams which total the approximate mass of the slug of the prior art but with a total surface area significantly greater than that of the prior art slug. Thus, with the subject diffuser plate in place, water entering the steam conduit will be more rapidly heated to vapor phase while avoiding the problems associated with the prior art.

The present invention has been shown as it would be utilized at a single location within a steam generation system. It is to be understood that many such diffusion plates could be used in such a system at any point where cold water might be expected to impinge upon steam.

It should also be noted that the present invention would be useful in a steam quality control system in which water is intentionally injected into a steam flow. The subject diffuser plate would serve to reduce the possibility of condensation shock in this instance also.

The described embodiment is intended in all respects to be illustrative and not restrictive of the scope of the invention. This embodiment may be subject to modification and change without departing from the spirit or essential characteristics of the present invention as defined by the appended claims.

We claim:

1. In a stream system in which residual cold water encounters hot steam headers during system startup, means to reduce condensation shock comprising:

a diffusion plate mounted in a steam generator discharge pipe in close proximity to an intersection within said steam system, said plate having a patterned array of apertures, said apertures being of sufficient number to not unduly restrict flow of water through said diffusion plate while breaking up residual cold water passing therethrough into a plurality of discrete water streams whereby the total surface area of the residual cold water exposed to the steam is substantially increased thus allowing more rapid heat transfer and reduction in condensation shock.

2. The means according to claim 1 wherein said diffusion plate further includes a drain slot.

3. The means according to claim 1 wherein said diffusion plate further includes a radially extending indicator tab.

4. The means according to claim 1 wherein each said aperture is tapered to converge in the downstream direction.

5. A method to substantially reduce condensation shock during start-up of a steam system, said shock resulting from large slugs of residual cold water within the system encountering headers heated by newly introduced high quality steam, comprising:

diffusing said residual cold water into a plurality of discrete streams wherever it impinges upon said steam whereby said residual cold water has an increased surface area thereby enhancing heat transfer from the steam to the water and reducing condensation shock.

* * * * *

UNITED STATES PATENT AND TRADEMARK OFFICE

CERTIFICATE OF CORRECTION

PATENT NO. : 4,989,551

DATED : Feb. 5, 1991

INVENTOR(S) : Hugh M. Sardoff and Hung Q. Bui

It is certified that error appears in the above-identified patent and that said Letters Patent is hereby corrected as shown below:

Claim 1, Col. 4, Line 1 delete "stream" and substitute --steam--.

Signed and Sealed this

Thirtieth Day of June, 1992

*Attest:*

DOUGLAS B. COMER

*Attesting Officer*

*Acting Commissioner of Patents and Trademarks*